United States Patent [19]

Bernhardt

[11] 4,174,592

[45] Nov. 20, 1979

[54] LAPIDARY DEVICE

[76] Inventor: Paul E. Bernhardt, 1728 E. 3rd St., Long Beach, Calif. 90802

[21] Appl. No.: 939,071

[22] Filed: Sep. 1, 1978

[51] Int. Cl.[2] ..... B24B 5/16

[52] U.S. Cl. ..... 51/101 R; 51/229

[58] Field of Search ..... 51/229, 101 R, 127

[56] References Cited

U.S. PATENT DOCUMENTS

| | | | |
|---|---|---|---|
| 3,041,789 | 7/1962 | Cretin-Maitenaz | 51/101 R |
| 3,834,085 | 9/1974 | Moeller | 51/229 |
| 3,943,664 | 3/1976 | Broide | 51/101 R |
| 3,973,360 | 8/1976 | Grevoisier | 51/101 R |

*Primary Examiner*—Harold D. Whitehead

*Attorney, Agent, or Firm*—William C. Babcock

[57] ABSTRACT

A power driven lapidary device for use in automatically grinding a sheet rock blank that has a generally elliptical shape to that of a cabichon, with the ground cabichon conforming in configuration to that of a cabichon-shaped rigid pattern. Both the blank and the cabichon-shaped pattern are concurrently subjected to rotation and to two rocking motions, with the blank being in abrasive contact with a grinding wheel, and the pattern being in rotatable and slidable contact with a rigid, curved, vertically extending surface that has substantially the same radius of curvature as the outer periphery of the grinding wheel with which it is aligned. By adjusting the curved surface relative to the pattern the transverse cross-section to which the blank is ground to a cabichon configuration may be controlled.

5 Claims, 13 Drawing Figures

FIG. 4
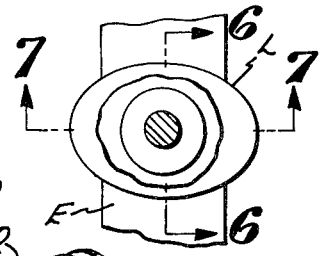
FIG. 1
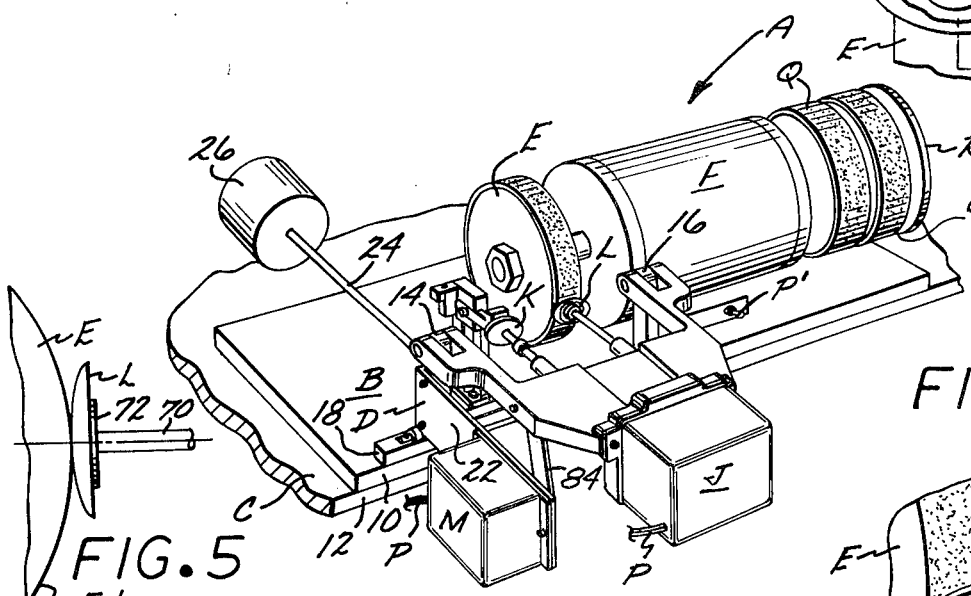
FIG. 3
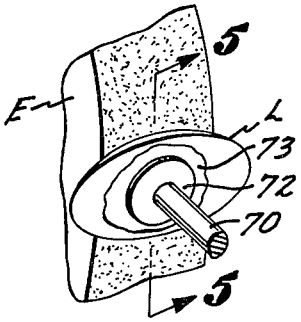
FIG. 5
FIG. 6
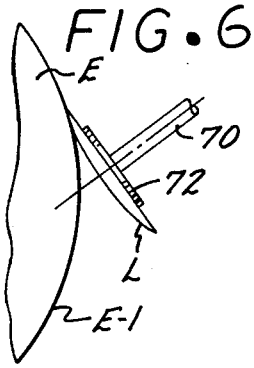
FIG. 2
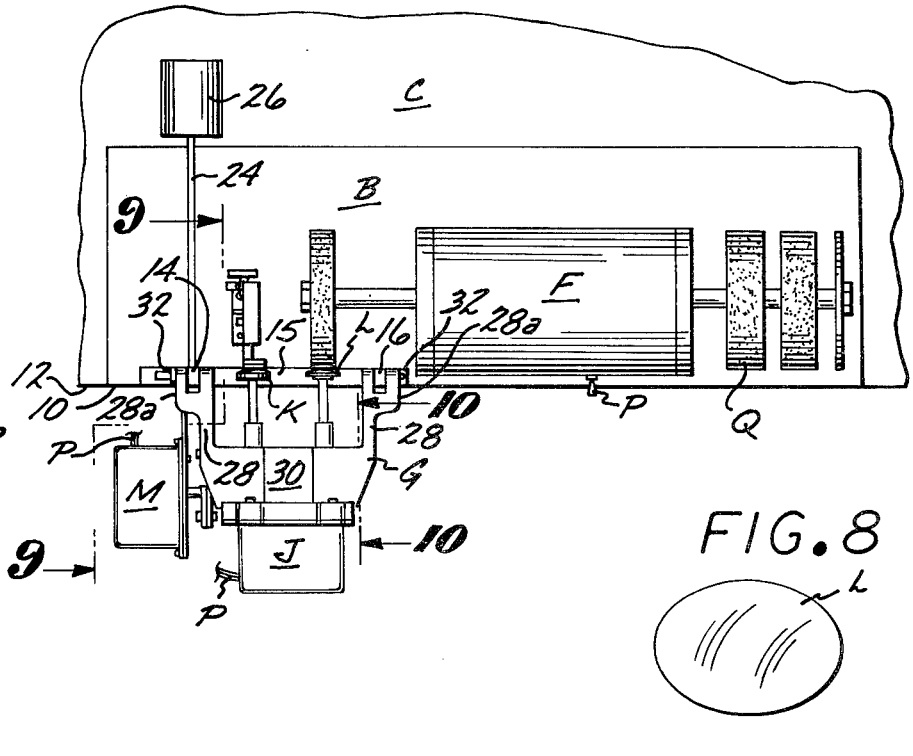
FIG. 7
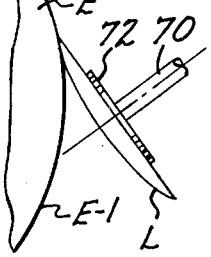
FIG. 8

LAPIDARY DEVICE

DESCRIPTION OF PRIOR ART

In the lapidary art, decorative stone is frequently cut into sheets approximately one-eighth to one-quarter inch in thickness and these sheets being subsequently sawed or otherwise cut into smaller pieces of generally elliptical shape. The smaller pieces serve as blanks to be subsequently transformed by grinding and polishing into cabochons either by laborious hand forming and hand polishing that is time consuming and requires a high degree of skill, or by using machines that require substantial experience and dexterity to operate the same properly.

A major object of the present invention is to provide a lapidary device that has a relatively simple mechanical structure, is power driven, requires a minimum of skill to operate, and one that accurately and precisely transforms a rough cut generally elliptical sheet of rock into a cabochon that conforms accurately and precisely to the periphery and surface configuration of a desired pattern.

Another object of the invention is to furnish a lapidary device that simplifies the grinding a rough cut blank into a cabochon of desired configuration with a minimum of effort and in a minimum of time.

SUMMARY OF THE INVENTION

The lapidary device of the present invention is used in automatically transforming a generally elliptical shaped piece of sheet rock that serves as a blank into a cabochon of smaller transverse area that conforms to the periphery and convex surface configuration of a rigid pattern. A number of rigid patterns are produced that vary in transverse cross section as well as convex configuration and any one of these may be used in the invention to reproduce the same configuration on the rock's blank. The invention includes a flat base that has a first longitudinal edge and an upper surface, with the base preferably being supported on a table, and the table also having a first longitudinal edge that lies in the same vertical plane as that of the first longitudinal edge of the base. A frame assembly is provided that includes first and second longitudinally spaced members that are disposed above the upper surface of the base and located adjacent the first longitudinal edge thereof, with the members being transversely disposed relative to the first longitudinal edge. A grinding wheel is positioned above the upper surface of the base and is situated intermediate the first and second members and inwardly therefrom, with the grinding wheel having a flat peripheral outer abrasive surface. The grinding wheel is rotated by a first electric motor that is secured to the upper surface of the base. The frame assembly due to a weight or other means when the rock's blank is being ground, tends to pivot on the base towards the grinding wheel. The first and second members serve to pivotally support a yoke therebetween with the yoke including a pair of spaced legs that project away from the grinding wheel and a web that extends between the portion of the pair of legs most remote from the grinding wheel.

A stop extends upwardly from the base and is inwardly disposed relative to the web. First and second longitudinally spaced, transverse shafts are rotatably supported from the web and situated between the legs, with the first shaft transversely aligned with the stop, and the second shaft likewise aligned with the grinding wheel.

The yoke serves to support in a fixed position thereon, a second electric motor that concurrently rotates both the first and second shafts.

A rigid cabochan pattern is transversely mounted in a centered position on the end of the first shaft most adjacent the stop. The second shaft has the rock blank transversely supported in a centered position on the end of the second shaft closest the periphery of the grinding wheel. A third electric motor is provided that is geared down to slowly rotate a crank, which crank is pivotally connected to a link, and the link in turn being pivotally connected to the yoke. As the first and second shafts are driven, the yoke is slowly reciprocated upwardly and downwardly, with the rock blank being in pressure abrasive contact with the outer periphery of the grinding wheel. During the initial grinding of the rock blank, the pattern will not be in rotatable and slidable contact with the stop. However, after the rock blank has been reduced by grinding to have the same peripheral dimensions of the pattern, the pattern will thereafter slidably and rotatably contact the stop and with the movement of this contact relative to the stop being transformed to the movement of the rock blank relative to the periphery of the grinding wheel, and the rock blank being ground as a result thereof to a replica of the pattern.

After the rock blank has been ground to the configuration of the pattern, the stop prevents further grinding of the blank, and the machine will normally be turned off. However, should the operator of the invention for some reason fail to turn off the latter, no harm will be done to the cabochon that has been formed from the rock blank, as the pattern due to contact with the stop prevents further grinding of the cabochon.

After the cabochon has been formed as above described the motors of the invention are shut off, and the frame assembly is tilted to an upwardly extending position adjacent the base, with the cabochon then removed from the second shaft, or a new second shaft removably inserted in the invention to replace the one that has been removed, with the new second shaft having a new rock blank mounted thereon so that the above-described operation may be repeated to form a second cabochon.

This procedure is repeated time and time again to form a desired quantity of cabochons from the rock blanks.

BRIEF DESCRIPTION OF THE DRAWING

FIG. 1 is a perspective view of the lapidary device;

FIG. 2 is a top plan view of the device;

FIG. 3 is a fragmentary perspective view of the periphery of the grinding wheel with stone that is being formed into a cabochon being held in pressure contact with the abrasive surface thereof by a rotatable shaft assembly;

FIG. 4 is a rear elevational view of the stone blank that has been partially formed into a cabochon;

FIG. 5 is a transverse cross-sectional view of the partially formed cabochon taken on the line 5—5 of FIG. 3;

FIGS. 6 and 7 are side elevational views of the partially formed cabochon as it is rotated and concurrently reciprocated relative to the abrasive peripheral surface of the grinding wheel;

FIG. 8 is a rear elevational view of the stone blank after it has been transformed by grinding to have a peripheral edge portion of the same configuration as the pattern;

DESCRIPTION OF THE PREFERRED EMBODIMENTS

Figure 9:
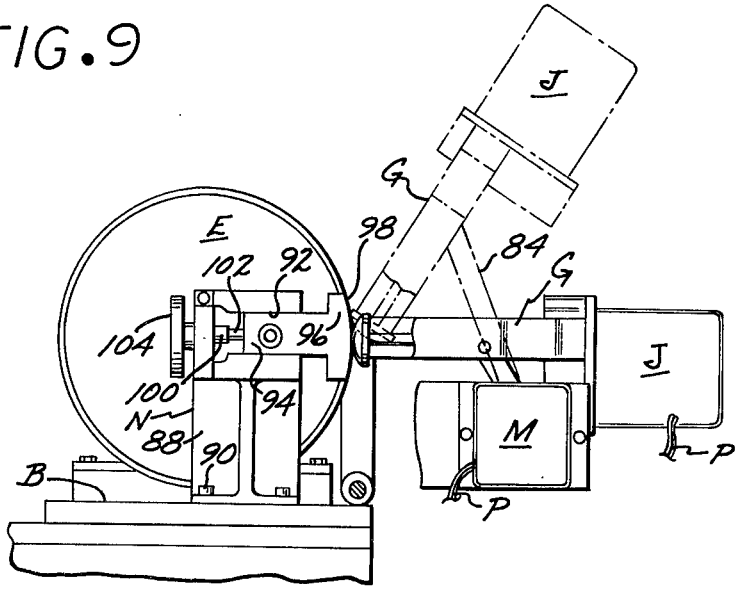
FIG. 9 is a side elevational view of the lapidary device, with a portion thereof broken away to illustrate the pattern being held in rotatable and sliding contact with a curve vertically extending surface that forms a part of a stop assembly.

The lapidary device A as can best be seen in FIGS. 1 and 2 includes an elongate rigid base B that has a first longitudinally extending edge surface 10. The base B is preferably supported on a table or bench C that has a flat horizontal upper surface and also a first longitudinal edge 12. The edges 10 and 12 are preferably located to lie in the same vertical plane.

The device A as may be seen in FIGS. 1 and 2 includes a rigid frame assembly D that has first and second spaced end members 14 and 16 that extend upwardly from a cross member 15. A grinding wheel E is disposed above the surface of the base B and is located intermediate the first and second members 14 and 16 as shown in FIGS. 1 and 2. The grinding wheel E is driven by a first electric motor F that is mounted on the base B by conventional means.

The frame assembly D is pivotally supported on the base B adjacent the longitudinal edge 10 by conventional means, such as spaced lugs 18 that extend upwardly from the base and have pins 20 supported therefrom that engage aligned openings formed in the cross member 15. The first end member 14 includes a plate 22 that is secured thereto by bolts or the like, and extends outwardly from the edge surface 10 as may be seen in FIG. 1 when the frame is disposed in a stone grinding position.

The first end member 14 as may be seen in FIGS. 1 and 2 has a rod 24 extending outwardly therefrom, with the rod on the free extremity thereof supporting a weight 26 of a desired magnitude.

Figure 11:
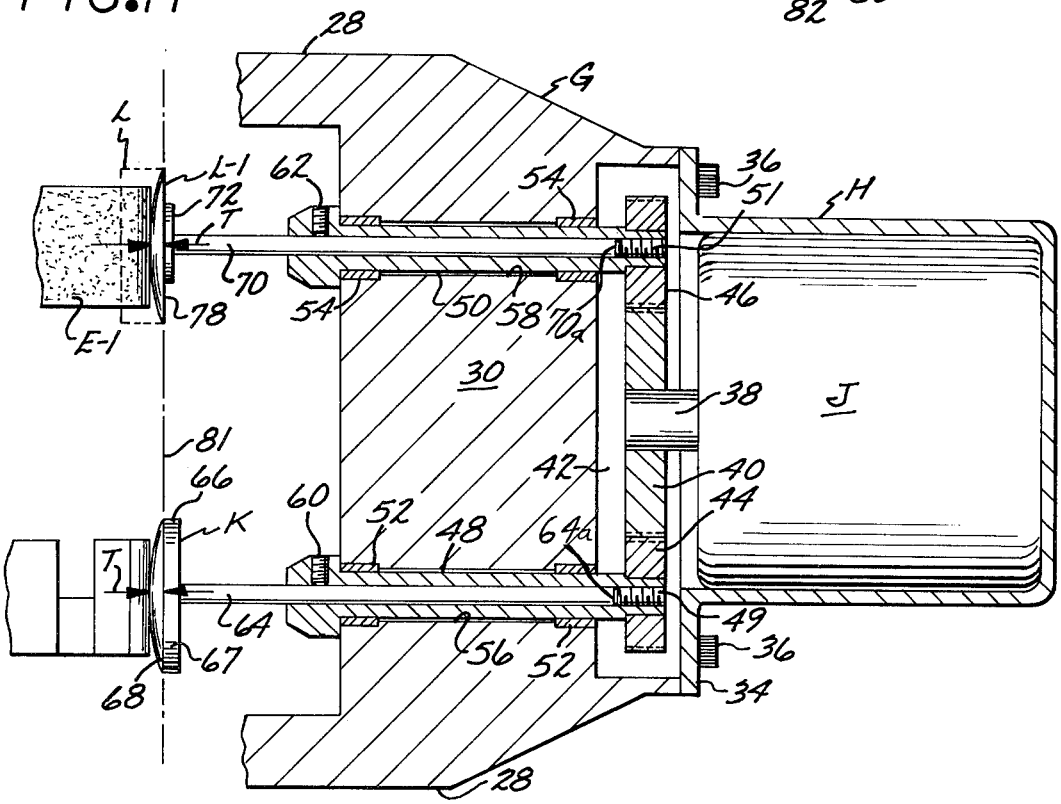
FIG. 11 is a combined top plan view and horizontal cross sectional view of the yoke assembly.

The invention A includes a yoke assembly G shown in FIGS. 1 and 2, and in detail in FIG. 11. The yoke assembly G includes a pair of laterally spaced parallel legs that have bifurcated free ends 28*a*. The legs 28 on the ends thereof are opposite the bifurcated ends 28*a* are connected by a transverse web 30.

The first and second end members 14 and 16 extend upwardly into the bifurcated ends 28*a* and are pivotally connected thereto by pins 32 that extend through openings in the bifurcated ends and the upward extremities of the first and second members. The yoke assembly G as may best be seen in FIG. 11 includes a housing H that has a forwardly disposed flange 34 that is secured to the web 30 by bolts 36 or other conventional means. The housing H has a second electric motor J disposed therein, which motor has a drive shaft 38 projecting forwardly therefrom and the drive shaft having a first gear 40 secured thereto as may be seen in FIG. 11. The first gear 40 is located in a cavity 42 that is formed in the web 30. The first gear 40 is in toothed engagement with second and third gears 44 and 46. The second gear 44 is connected to a rearwardly disposed end of a first tubular sleeve 48 and the second gear 46 is likewise secured to a second tubular sleeve 50 as shown in FIG. 11. The first and second tubular sleeves 48 and 50 are rotatably supported by bearings 52 and 54 located in transversely spaced first and second bores 56 and 58 formed in the web 30.

The forwardly disposed end portions of the sleeves are in the form of enlarged heads as may be seen in FIG. 11 that serve as thrust bearings, and have first and second set screws 60 and 62 mounted therein for reasons that will later be explained.

A first shaft 64 is longitudinally disposed in the first sleeve 48 and is removably held in position therein by tightening the set screws 60. The first shaft 64 is of sufficient length as to extend forwardly a substantial distance from the forward extremity of the first sleeve 48. The forward end of the first shaft 64 has a cabochon defining pattern mounted thereon, which pattern includes an elliptical plate 66, that has a convex forwardly extending surface 68.

A number of shafts 64 are provided with various shaped patterns K mounted on the ends thereof, and the configuration to which a stone L will be ground is dependent on the particular pattern K selected for use with the invention A.

A second shaft 70 is also provided that extends longitudinally through the second sleeve 50 and is secured in a non-rotatable position relative thereto by tightening the second set screw 62. The second shaft 70 is of sufficient length that it extends forwardly from the second sleeve 50 a substantial distance, and the second shaft having a centered plate 72 secured thereto, which plate serves as a mounting for the stone blank L that is to be ground to a cabochon defining configuration.

Figure 12:
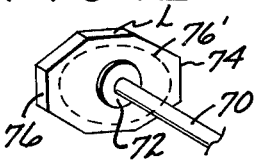
FIG. 12 is a perspective view of the rock blank removably mounted on an end portion of a shaft, and the phantom line illustrating the periphery to which the blank will be ground to conform to the configuration of the pattern.

The stone L as may be seen in FIG. 3 is secured to the plate 72 by a suitable adhesive or bonding agent 73. In FIG. 12 it will be seen that the stone L is in the form of a blank of sheet rock 74 that has a rough cut outer peripheral edge surface 78, which after grinding on the assembly A will be reduced to the elliptical peripheral edge 76' shown in phantom line in FIG. 12. The outer peripheral edge 76' will be the same as the outer periphery of the pattern K.

Figure 10:
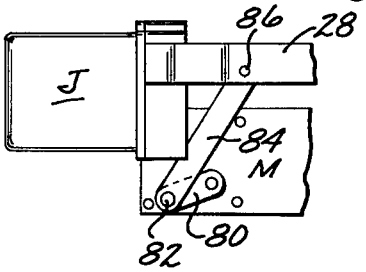
FIG. 10 is a fragmentary side elevational view of a portion of the invention that illustrates the linkage utilized in reciprocating the yoke upwardly and downwardly.

The plate 22 of frame assembly D as may be seen in FIG. 2 supports a third motor M that has a geared down drive shaft (not shown) that operates a crank 80, which crank is best seen in FIG. 10. The crank 80 has the outer extremity thereof pivotally connected by a pin 82 to an end portion of a rigid link 84 that extends upwardly as shown in this figure and by a pin 86 is pivotally connected to one of the legs 28.

The invention A also includes a stop assembly N that includes an upright 88 that is secured to the upper surface of the base B by bolts 90 or other conventional fastening means as shown in FIG. 9. The upright 88 has a horizontal space 92 defined therein in which a slide 94 is disposed. The slide 94 on a first end 94*a* thereof as shown in FIG. 9 defines an elongate body 96 that has a vertically extending curve surface 98 formed thereon that may be engaged both rotatably and slidably by pattern K.

The upright 88 supports a hollow shaft 100 having internal threads formed therein which threads engage threads on a rod 102 secured to the slide 94. By rotating the shaft 100 by a handle 104 that is provided for that purpose, the slide may be moved transversely relative to the base B to a desired position. The radius of curvature of the surface 98 is substantially the same as the abrasive periphery of the grinding wheel E, with the periphery and surface 98 being in substantial alignment. By moving the curved surface 98 away from first edge 10, the transverse cross section of the ground cabichon will be decreased. Conversely, by moving the surface 98 towards first edge 10 the transverse cross section of the ground cabichon will be increased.

The use and operation of the invention A is extremely simple. The weight 26 is grasped manually and then moved towards the user, with the rod 24 concurrently pivoting the frame assembly D to a position where the first and second shafts 64 and 70 are substantially vertically disposed.

A first shaft 64 having a cobachon pattern K of desired convexity and periphery supported on one end thereof is selected, with the first shaft inserted into the first sleeve 48 and secured in a non-rotatable position therein by tightening the first set screw 60. The second shaft 70 is similarly mounted in the second sleeve 50. The second shaft 70 removably supports the stone blank L from the plate 72. The thickness of the stone blank L must be greater than the distance T on the pattern K, which distance is shown in FIG. 11. Also, the major and minor axis of the blank L must be greater than those of the pattern K.

The exterior abrasive surface E-1 of grinding wheel and the curved surface 98 are of the same radius of curvature and are horizontally aligned with one another. First and second set screws 49 and 51 are threadedly mounted in the ends of the first and second sleeves 48 and 50 most adjacent the second and third gears 44 and 46 with the set screws acting as stops.

The first and second shafts 64 and 70 are of such length that when the ends **64*a* and 70*a* are in abutting contact with screws 49 and 51, the surface 78 and the line 67 on pattern K are in alignment as indicated by broken line 81 in FIG. 11**.

After a stone blank L of the size shown in phantom line in FIG. 11 and in solid line in FIG. 12 has been secured to plate 72, the weight 26 and frame D are returned to the position shown in FIG. 1. Electric power is now concurrently supplied to motors F, J and M through conductors P.

Figure 13:
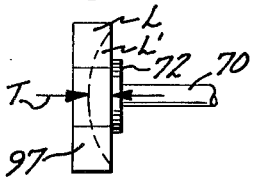
FIG. 13 is a side elevational view of the blank mounted on the end portion of a shaft, and the phantom line illustrating an end view of the capochon that is to be formed from the rock blank.

From the size of the stone blanks L shown in FIGS. 11 and 13, it will be apparent that initially the pattern K will not be in contact with guide surface 96, but will only contact surface 96 after at least a part of the surplus rock portion 97 has been ground away. During this portion of the operation both the frame assembly D and the yoke assembly G will reciprocate relative to the base B, and so continue until the cabachon L-1 is completed. As the grinding continues, the convex surface 68 of pattern K will rotatably and slidably contact surface 96 as additional rock is taken from blank L. The configuration of the convex surface 68 will determine the position of the rock removed from the blank L until it has been transformed to the cabachon L-1. The maximum thickness T of pattern K will determine the maximum thickness T of the cabachon L-1. After the cabachon L-1 has been formed, the pattern K will simply rotate and reciprocate relative to the surface 96 and prevent further grinding of the blank L. The first motor F not only drives the grinding wheel E, but a polishing and buffing wheels Q and sanding disk R.

The use and operation of the invention has been explained previously in detail and need not be repeated.

What is claimed is:

1. A lapidary device for use in automatically transforming a generally elliptical shaped piece of rock that serves as a blank into a cabachon of smaller transverse area that conforms to the periphery and convex surface configuration of a rigid pattern, which device includes:

a. a flat base that has a first longitudinal edge and an upper surface;

b. a frame assembly that includes first and second longitudinally spaced members transversely disposed on said base adjacent said first edge above said upper surface thereof and pivotally supported on said base;

c. a grinding wheel disposed above said upper surface intermediate said first and second members, said grinding wheel having a flat peripheral outer abrasive surface;

d. first power operated means for rotating said grinding wheel;

e. first means that tend to pivot said frame assembly towards said grinding wheel with a first force;

f. a yoke pivotally supported from said frame assembly, said yoke including a pair of spaced legs that project away from said grinding wheel and a web that extends between the portions of said pair of legs most remote from said grinding wheel;

g. guide means that extend upwardly from said base, said guide means defining a vertically extending curved surface of substantially the same radius of curvature as the abrasive periphery of said grinding wheel and aligned therewith;

h. first and second longitudinally spaced, transverse shafts rotatably supported from said web between said legs, said first shaft transversely aligned with said guide surface, and said second shaft transversely aligned with said grinding wheel;

i. second power operated means for concurrently rotating said first and second shafts;

j. a rigid cabachon pattern transversely mounted in a centered position on the end of said first shaft most adjacent said guide surface;

k. second means for removably supporting said rock blank in a substantially centered position on the end of said second shaft closest said abrasive periphery of said grinding wheel; and l. third power operated means that concurrently reciprocate said yoke, first and second shafts, pattern and rock blank upwardly and downwardly relative to said frame assembly concurrently with the rotation of said first and second shaft, and said frame also reciprocating upwardly and downwardly relative to said base during the grinding operation due to the rotation of said rock blank relative to said grinding wheel with which it is in pressure contact, said reciprocation of said frame relative to said base continuing until said rock blank has been formed into said cabachon, and the grinding of the convex surface on said rock blank being controlled by the convex surface of said pattern that is in rotatable sliding contact with said guide surface.

2. A lapidary device as defined in claim 1 which in addition includes:

m. third means for longitudinally adjusting said first and second shafts relative to said yoke assembly to permit the full convex surface configuration to be reproduced on said rock blank to define said cabichon.

3. A lapidary device as defined in claim 1 in which said first means is:

m. a rod secured to said frame assembly and extending over said base at an elevated position relative thereto when said frame and yoke are in a position for grinding said rock blank; and n. a weight supported on the free end of said rod, said weight of such magnitude as to exert said force on said frame, and said weight when grasped also serving as a handle to permit said rod to serve as a lever to pivot said frame and yoke away from said grinding wheel to a position where said frame is substantially vertically disposed to permit said first and second shafts to be mounted on said yoke or removed therefrom.

4. A lapidary device as defined in claim 1 in which said curved surface of said guide means has substantially the same radius of curvature as said abrasive surface of said grinding wheel and is in alignment with said abrasive surface.

5. A lapidary device as defined in claim 1 which in addition includes:

m. third means for adjusting said guide means relative to said pattern to alter the cabachon configuration to which said rock blank will be ground.

* * * * *